US005398459A

United States Patent [19]

Okumura et al.

[11] Patent Number: 5,398,459

[45] Date of Patent: Mar. 21, 1995

[54] METHOD AND APPARATUS FOR POLISHING A WORKPIECE

[75] Inventors: Katsuya Okumura, Poughkeepsie; Tohru Watanabe, Hopewell Junction, both of N.Y.; Riichirou Aoki, Kawasaki, Japan; Hiroyuki Yano, Wappingers Falls, N.Y.; Masako Kodera; Atsushi Shigeta, both of Kawasaki, Japan; You Ishii, Tokyo, Japan; Norio Kimura, Tokyo, Japan; Masayoshi Hirose, Tokyo, Japan; Yukio Ikeda, Tokyo, Japan

[73] Assignees: Kabushiki Kaisha Toshiba, Kanagawa; Ebara Corporation, Tokyo, both of Japan

[21] Appl. No.: 156,641

[22] Filed: Nov. 24, 1993

[30] Foreign Application Priority Data

Nov. 27, 1992 [JP] Japan ..... 4-341162

[51] Int. Cl.[6] ..... B24B 1/00

[52] U.S. Cl. ..... 451/41; 451/286; 451/388

[58] Field of Search ..... 51/129, 131.1, 131.2, 51/131.3, 131.4, 131.5, 133, 235, 277, 283 R

[56] References Cited

U.S. PATENT DOCUMENTS

| | | | |
|---|---|---|---|
| 1,491,103 | 4/1924 | Hoke . | |
| 3,304,662 | 2/1967 | Boettcher | 51/131.2 |
| 3,374,582 | 3/1968 | Boettcher | 51/131.2 |
| 3,453,783 | 7/1969 | Queen | 51/131.2 |
| 3,570,188 | 3/1971 | Ebner | 51/131.2 |
| 3,841,028 | 10/1974 | Katzke | 51/235 |
| 4,002,246 | 1/1977 | Brandt et al. | 51/235 |
| 4,009,540 | 3/1977 | Uijen | 51/235 |
| 4,256,535 | 3/1981 | Banks . | |
| 4,373,991 | 2/1983 | Banks . | |
| 4,502,252 | 3/1985 | Iwabuchi | 51/131.2 |
| 4,567,938 | 2/1986 | Turner | 51/235 |
| 4,671,145 | 6/1987 | Fehrenbach et al. | 51/235 |
| 5,232,875 | 8/1993 | Tuttle et al. | 51/131.2 |

OTHER PUBLICATIONS

Patent Abstracts of Japan, vol. 10, No. 122 (M-476)(2179) May 7, 1986.

Bonora, "Flex-Mount Polishing of Silicon Wafers", *Solid State Technology*, Oct. 1977, pp. 55-62.

*Primary Examiner*—Maurina T. Rachuba

*Attorney, Agent, or Firm*—Wenderoth, Lind & Ponack

[57] ABSTRACT

A workpiece such as a semiconductor wafer is positioned between a turntable and a top ring and polished by an abrasive cloth on the turntable while the top ring is being pressed against the turntable. The top ring has a retaining ring for preventing the workpiece from deviating from the lower surface of the top ring, and the retaining ring has an inside diameter larger than an outside diameter of the workpiece. The rotation of the turntable imparts a pressing force in a direction parallel to the upper surface of the turntable to the workpiece so that an outer periphery of the workpiece contacts an inner periphery of the retaining ring, and the rotation of the retaining ring imparts a rotational force to the workpiece so that the workpiece performs a planetary motion relative to the top ring in the retaining ring.

15 Claims, 14 Drawing Sheets b > a'  b < T

METHOD AND APPARATUS FOR POLISHING A WORKPIECE

BACKGROUND OF THE INVENTION

1. Field of the Invention

The present invention relates to a method and apparatus for polishing a workpiece, and more particularly to a method and apparatus for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 μm wide, it requires that surfaces on which pattern images are to be focused on by a stepper be as flat as possible because the depth of focus of the optical system is relatively small.

It is therefore necessary to make the surface of semiconductor wafers flat for photolithography. One customary way of flattening the surface of semiconductor wafers is to polish them with a polishing apparatus.

Conventionally, such a polishing apparatus has a turntable, and a top ring which exerts a constant pressure on the turntable. An abrasive cloth is attached to the upper surface of the turntable. A semiconductor wafer to be polished is placed on the abrasive cloth and clamped between the top ring and the turntable. The semiconductor wafer is securely fixed to the lower surface of the top ring by wax, a pad or a suction so that the semiconductor wafer can be rotated integrally with the top ring during polishing.

However, in the conventional polishing apparatus, since the semiconductor wafer is fixed on the lower surface of the top ring, small convex surfaces are formed on the semiconductor wafer to be polished by dust particles interposed between the semiconductor wafer and the lower surface of the top ring. The convex surfaces on the semiconductor wafer tend to be overpolished, thus forming a plurality of thin spots, so-called bull's-eye. In order to avoid formation of the bull's-eye, dust particles must be perfectly removed by washing the lower surface of the top ring, or an elastic material such as wax or a pad must be interposed between the semiconductor wafer and the lower surface of the top ring so as not to form the convex surfaces by dust particles.

However, it is difficult to remove dust particles perfectly by the washing process and to judge whether dust particles are perfectly removed or not. Further, to attach the semiconductor wafer to the top ring using wax is troublesome and time-consuming.

Furthermore, in case of interposing an elastic material such as a pad between the semiconductor wafer and the lower surface of the top ring, repeated pressure applied to the elastic material makes the service life of the elastic material relatively short.

SUMMARY OF THE INVENTION

It is therefore an object of the present invention to provide a method and apparatus for polishing a workpiece such as a semiconductor wafer which can polish the workpiece to a flat mirror finish having no bull's-eye, without using an elastic material such as wax or a pad interposed between the workpiece and the lower surface of the top ring.

According to one aspect of the present invention, there is provided a polishing apparatus for polishing a surface of a workpiece having a substantially circular shape, comprising: a turntable with an abrasive cloth mounted on an upper surface thereof; a top ring positioned above the turntable for supporting the workpiece to be polished and pressing the workpiece against the abrasive cloth, the top ring having a planarized lower surface which contacts an upper surface of the workpiece which is a backside of the workpiece; first actuating means for rotating the turntable; second actuating means for rotating the top ring; and a retaining ring provided on the lower surface of the top ring for preventing the workpiece from deviating from the lower surface of the top ring, the retaining ring having an inside diameter larger than an outside diameter of the workpiece; wherein rotation of the turntable imparts pressing force in a direction parallel to the upper surface of the turntable to the workpiece so that an outer periphery of the workpiece contacts an inner periphery of the retaining ring, rotation of the retaining ring imparts rotational force to the workpiece so that the workpiece performs a planetary motion relative to the top ring within the retaining ring.

The retaining ring is made of a resin material. The clearance defined by the difference between the inside diameter of the retaining ring and the outside diameter of the workpiece is in the range of approximately 0.5 to 3 mm.

According to another aspect of the present invention, there is provided a method of polishing a surface of a workpiece having a substantially circular shape, comprising the steps of: positioning the workpiece between a turntable with an abrasive cloth mounted on an upper surface thereof and a top ring positioned above the turntable, the top ring having a planarized lower surface and a retaining ring provided on the lower surface, the retaining ring preventing the workpiece from deviating from the lower surface of the top ring, the retaining ring having an inside diameter larger than an outside diameter of the workpiece; rotating the turntable and the top ring; and pressing the workpiece against the abrasive cloth by the top ring; wherein the rotation of the turntable imparts a pressing force in a direction parallel to the upper surface of the turntable to the workpiece so that an outer periphery of the workpiece contacts an inner periphery of the retaining ring, rotation of the retaining ring imparts said rotational force to the workpiece so that the workpiece performs a planetary motion relative to the top ring in the retaining ring.

According to a preferred embodiment, when the outside diameter of the workpiece is D(mm), the difference between the inside diameter of the retaining ring and the outside diameter of the workpiece is d(mm), the rotational speed of the top ring r(r.p.m.) and polishing time t(sec) are selected so as to satisfy $(d/D)\cdot r\cdot t \geqq 60$.

According to the present invention, a workpiece such as a semiconductor wafer is not fixed to the lower surface of the top ring, and hence the workpiece does not move together with the top ring. Since the workpiece performs a planetary motion relative to the top ring within the retaining ring, the workpiece is constantly moved relative to the lower surface of the top ring. Even if dust particles are interposed between the workpiece and the lower surface of the top ring, convex surfaces formed on the workpiece by dust particles are constantly relocated on the workpiece without remaining in the original locations, the influence which dust particles exercise on the workpiece is distributed over the entire surface of the workpiece, and thus the workpiece can be polished highly accurately to a flat mirror finish.

More specifically, as shown in FIG. 6, when a dust particle'S is interposed between the semiconductor wafer 6 and the lower surface of the top ring 3, a concave surface is formed on the lower surface of the semiconductor wafer 6, which is a frontside of the semiconductor wafer 6, due to the dust particle S. Therefore, the concave surface tends to be overpolished due to local contact with the abrasive cloth 23 on the turntable 20. The closer the surface approaches to the central portion of the concave surface, the more the surface is removed. As a result, bull's-eyes 6*a*, 6*a* having a certain pattern similar to contour lines are formed on the semiconductor wafer as shown in FIG. 7. This is because the semiconductor wafer 6 is fixed to the top ring 3, stress is concentrated on the concave surface where the dust particle S is positioned.

However, according to the present invention, since the semiconductor wafer 6 performs the planetary motion relative to the top ring in the wafer retaining ring 5, the concave surface which is overpolished due to the dust particle S is constantly moved on the semiconductor wafer 6 without remaining at the original location, and hence the influence which the dust particle S exercises on the semiconductor wafer 6 is distributed over the entire surface of the semiconductor wafer 6 and the bull's-eyes are not formed on the semiconductor wafer 6. Therefore, the semiconductor wafer 6 can be polished highly accurately to a flat mirror finish.

The above and other objects, features, and advantages of the present invention will become apparent from the following description of illustrative embodiments thereof in conjunction with the accompanying drawings.

DETAILED DESCRIPTION OF THE PREFERRED EMBODIMENTS

An embodiment of the present invention will be described below with reference to drawings.

Figure 1:
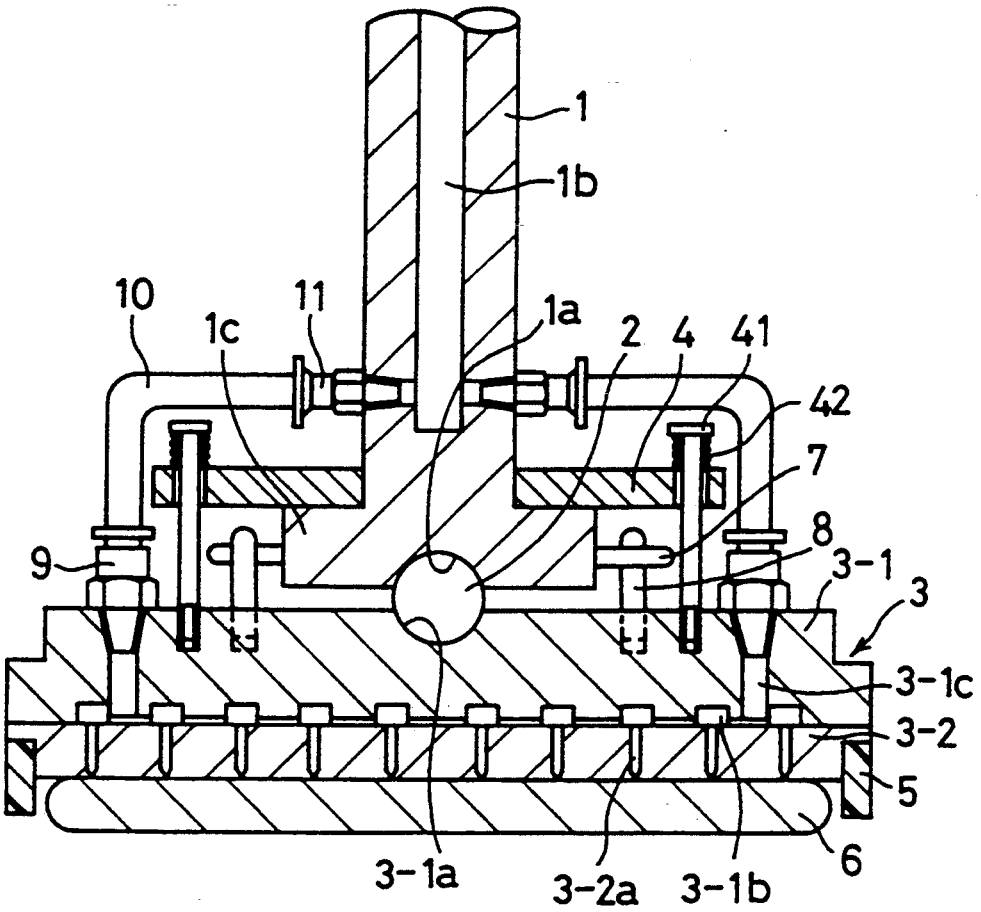
FIG. 1 is a sectional side view of the polishing unit of a polishing apparatus according to an embodiment of the present invention.
Figure 2:
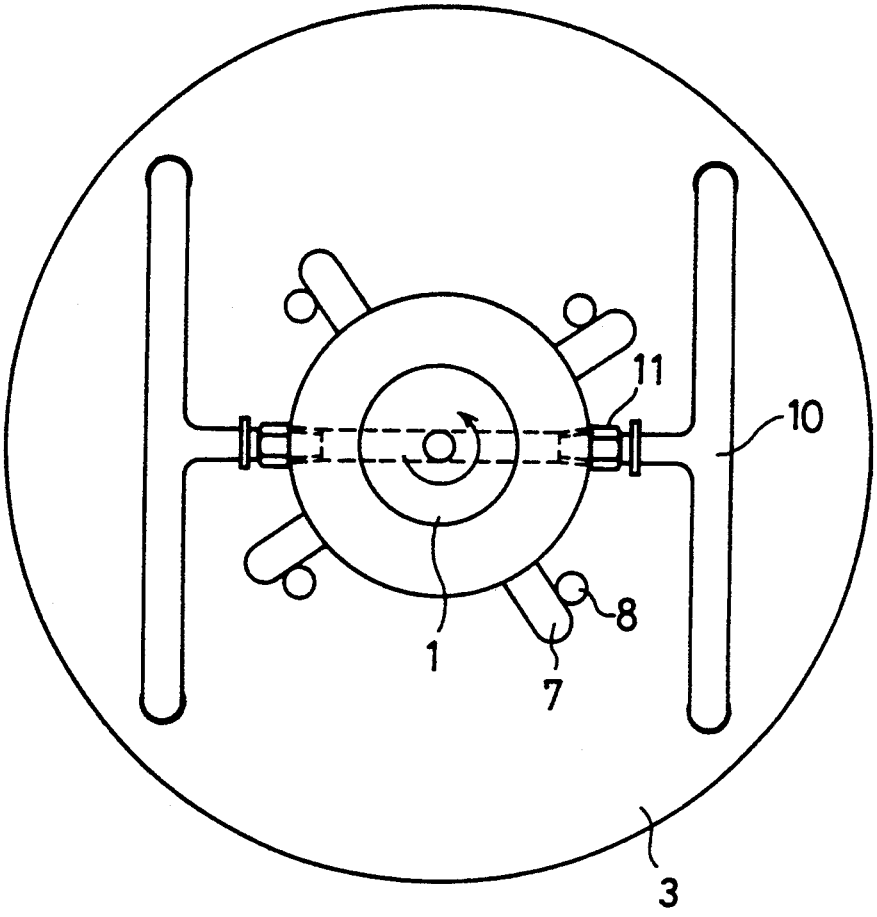
FIG. 2 is a plan view of the polishing unit in FIG. 1.

As shown in FIGS. 1 and 2, a polishing unit of the polishing apparatus according to the present invention comprises a vertical top ring drive shaft 1, a top ring 3 and a spherical bearing 2 interposed between the top ring drive shaft 1 and the top ring 3. The top ring drive shaft 1 has a central spherical concave surface la formed in a lower end thereof and held in sliding contact with the spherical bearing 2. The top ring 3 comprises an upper top ring member 3-1 and a lower top ring member 3-2 attached to the lower surface of the upper top ring member 3-1. The upper top ring member 3-1 has a central spherical concave surface 3-1*a* formed in an upper surface thereof and held in sliding contact with the spherical bearing 2. A wafer retaining ring 5 is mounted on a lower surface of the lower top ring member 3-2 along its outer circumferential edge.

The lower top ring member 3-2 has a plurality of vertical suction holes 3-2*a* formed therein. The vertical suction holes 3-2*a* are open at the lower surface of the lower top ring member 3-2. The upper top ring member 3-1 has a plurality of suction grooves 3-1*b* formed therein and communicating with the suction holes 3-2*a*, respectively, and a plurality of suction holes 3-1*c* (four in the illustrated embodiment) formed therein and communicating with the suction grooves 3-1*b*. The suction holes 3-1*c* are connected through tube couplings 9, vacuum line tubes 10, and tube couplings 11 to a central suction hole 1*b* formed axially centrally in the top ring drive shaft 1.

The top ring drive shaft 1 has a radially outwardly extending flange 1*c* on its lower end from which extends a plurality of torque transmission pins 7 (four in the illustrated embodiment) radially outwardly. The upper surface of the upper top ring member 3-1 has a plurality of torque transmission pins 8 (four in the illustrated embodiment) projecting upwardly for point contact with the torque transmission pins 7, respectively. As shown in FIG. 2, when the top ring drive shaft 1 is rotated about its own axis in the direction indicated by the arrow, the torque transmission pins 7 are held in point contact with the torque transmission pins 8, and cause the top ring 3 to rotate. Even if the top ring 3 is tilted relatively to the top ring drive shaft 1, the torque transmission pins 7, 8 remain reliably in point-to-point contact with each other, though they may contact each other at different positions, as long as the top ring drive shaft 1 is rotated.

Figure 3:
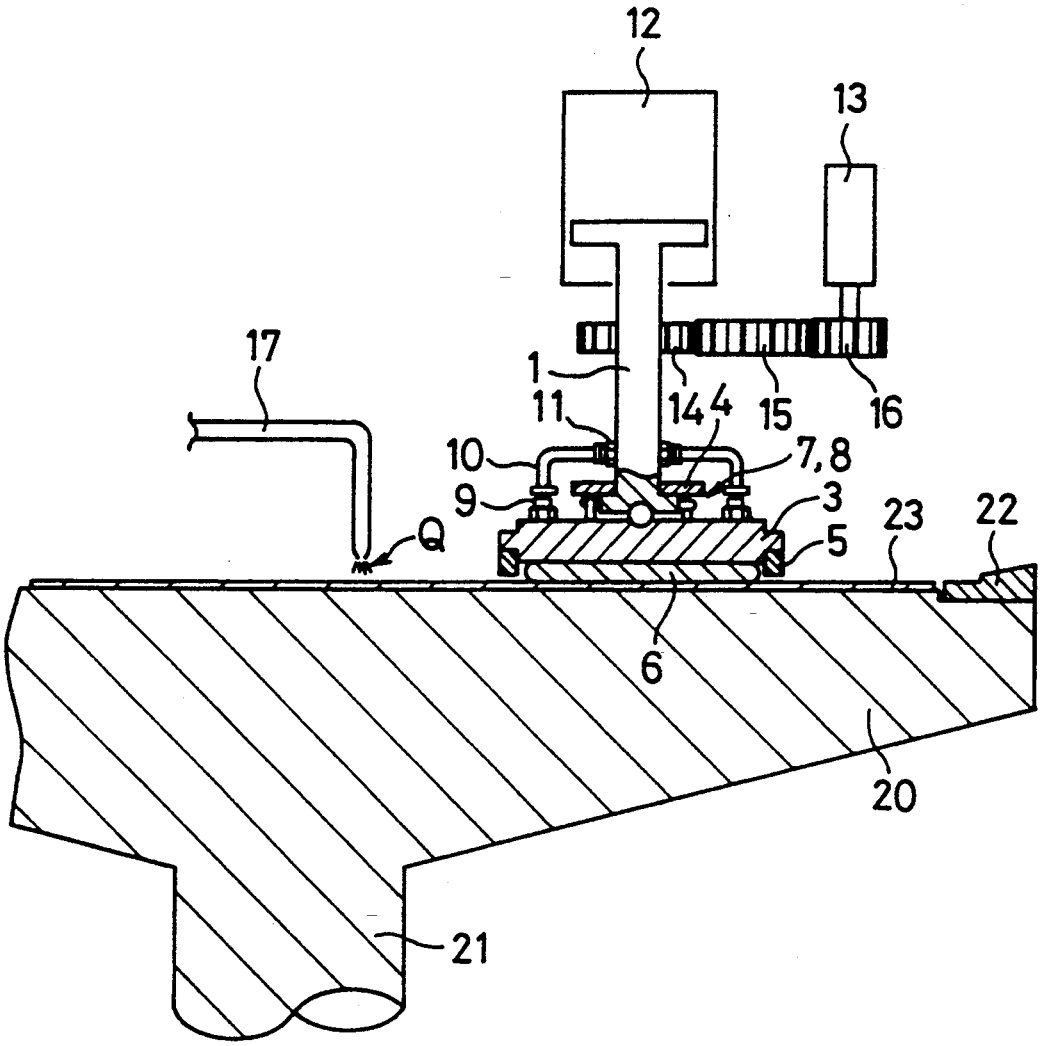
FIG. 3 is a partial sectional side view of the polishing apparatus according to an embodiment of the present invention.

A semiconductor wafer 6 to be polished by the polishing apparatus is accommodated in a space defined between the lower surface of the lower top ring member 3-2, the inner circumferential edge of the wafer retaining ring 5, and the upper surface of a turntable 20 (see FIG. 3). The turntable 20 has an abrasive cloth 23 disposed on its upper surface for polishing the lower surface of the semiconductor wafer 6.

In the operation, the turntable 20 is rotated and the top ring drive shaft 1 is rotated. The torque of the top ring drive shaft 1 is transmitted to the top ring 3 through point contact between the torque transmission pins 7, 8, thus rotating the top ring 3 with respect to the turntable 20. The semiconductor wafer 6 supported by the top ring 3 is thus polished by the abrasive cloth 23 on the turntable 20 to a flat mirror finish.

A top ring holder 4 is mounted on the flange 1*c* of the top ring drive shaft 1 and fixed to the top ring 3 by a plurality of vertical bolts 41 which extend through the top ring holder 4, and are threaded into the upper top ring member 3-1. Compression coil springs 42 are interposed between the heads of the bolts 41 and the top ring holder 4 for normally urging the top ring holder 4 to be held downwardly against the flange 1*c*. When the top ring drive shaft 1 with the top ring holder 4, is elevated upwardly, the compression coil springs 42 serve to keep the top ring 3 horizontally for thereby facilitating attachment and removal of the semiconductor wafer 6.

FIG. 3 shows the polishing apparatus which incorporates the polishing unit shown in FIGS. 1 and 2. As shown in FIG. 3, the turntable 20 is supported on a central shaft 21 and rotatable about the axis of the shaft 21. A turntable ring 22 for preventing an abrasive slurry or the like from being scattered around is mounted on the upper surface of the turntable 20 along its outer circumferential edge. The abrasive cloth 23 is positioned on the upper surface of the turntable 20 radially inwardly of the turntable ring 22.

The polishing unit shown in FIGS. 1 and 2 are located above the turntable 20. The top ring 3 is pressed against the turntable 20 under a constant pressure or a variable pressure by a top ring cylinder 12 which houses a slidable piston which is connected to the upper end of the top ring drive shaft 1. The polishing apparatus also has a top ring actuator 13 for rotating the top ring drive shaft 1 through a transmission mechanism comprising a Gear 14 fixed to the top ring drive shaft 1, a gear 16 coupled to the output shaft of the top ring actuator 13, and a gear 15 mesh engaged with the gears 14, 16. An abrasive slurry nozzle 17 is disposed above the turntable 20 for supplying an abrasive slurry Q onto the abrasive cloth 23 on the turntable 20.

Next, a method of polishing a semiconductor wafer will be described below using the polishing apparatus shown in FIGS. 1 through 3.

A semiconductor wafer 6 comprises a silicon substrate and a dielectric layer comprising silicon dioxide formed over the substrate, and the dielectric layer is polished by the polishing process according to the present invention.

First, the semiconductor wafer 6 is held under a vacuum on the lower surface of the lower top ring member 3-2 by connecting the central suction hole 1*b* to a vacuum source. To be more specific, when the central suction hole 1*b* is connected to the vacuum source, air is sucked from the vacuum holes 3-2*a* of the lower top ring member 3-2. From this state, the top ring 3 is moved to the semiconductor wafer 6 placed at a standby section (not shown) located adjacent to the turntable 20, and the semiconductor wafer 6 is attached under a vacuum to the lower surface of the lower top ring member 3-2.

Thereafter, the top ring 3 holding the semiconductor wafer 6 under a vacuum is moved above the turntable 20, and then the top ring 3 is lowered to place the semiconductor wafer 6 on the abrasive cloth 23 on the turntable 20. The vacuum hole 1*b* is then disconnected from the vacuum source and the pressure of the interior of the vacuum holes 3-2*a* are raised to the ambient pressure to thus release the semiconductor wafer 6 from the lower surface of the top ring 3. Therefore, the semiconductor wafer 6 becomes rotatable relative to the top ring 3. While the turntable 20 is being rotated by a motor (not shown), the semiconductor wafer 6 is pressed against the abrasive cloth 23 on the turntable 20 by the top ring 3.

At this time, the abrasive slurry Q is supplied from the abrasive slurry nozzle 17 onto the abrasive cloth 23. The supplied abrasive slurry Q is retained by the abrasive cloth 23, and infiltrates into the lower surface of the semiconductor wafer 6. The semiconductor wafer 6 is polished in contact with the abrasive cloth 23 impregnated with the abrasive slurry Q.

When the upper surface of the turntable 20 is slightly tilted during polishing of the semiconductor wafer, the top ring 3 is tilted about the spherical bearing 2 with respect to the top ring drive shaft 1. However, since the torque transmission pins 7 on the top ring drive shaft 1 are held in point-to-point contact with the torque transmission pins 8 on the top ring 3, the torque from the top ring drive shaft 1 can reliably be transmitted to the top ring 3 through the torque transmission pins 7, 8, though they may contact each other at different positions.

After polishing is completed, the semiconductor wafer 6 is held under a vacuum to the lower surface of the top ring 3 by connecting the central suction hole 1*b* to the vacuum source. The top ring 3 is moved to supply the semiconductor wafer 6 to a next process such as a washing process.

Figure 4:
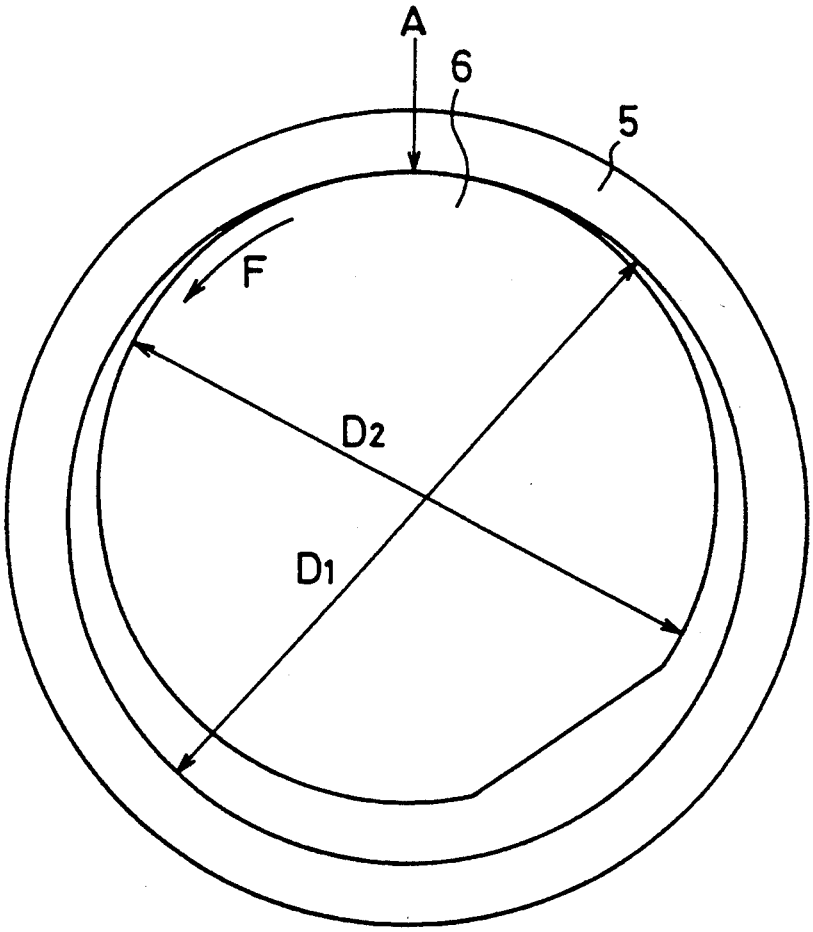
FIG. 4 is a plan view showing the relationship between a wafer retaining ring and a semiconductor wafer.

FIG. 4 shows the positional relationship between the semiconductor wafer 6 and the wafer retaining ring 5. As shown in FIG. 4, the semiconductor wafer 6 has an outside diameter of $D_2$ and the wafer retaining ring 5 has an inside diameter of $D_1$. A clearance d difined by the difference ($D_1$—$D_2$) is formed between the outer periphery of the semiconductor wafer 6 and the inner periphery of the wafer retaining ring 5, and the semiconductor wafer 6 contacts the wafer retaining ring 5 at the point A. Since the top ring 3 and the wafer retaining ring 5 are rotated, the rotating force F is applied to the outer periphery of the semiconductor wafer 6.

Figure 5:
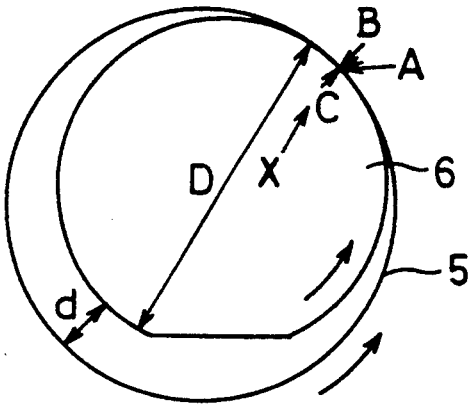
FIG. 5(*a*), FIG. 5(*b*) and FIG. 5(*c*) are schematic views showing the manner in which the semiconductor wafer performs planetary motion relative to the top ring.
Figure 5:
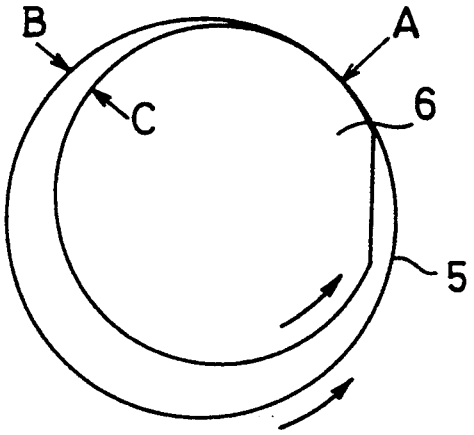
Figure 5:
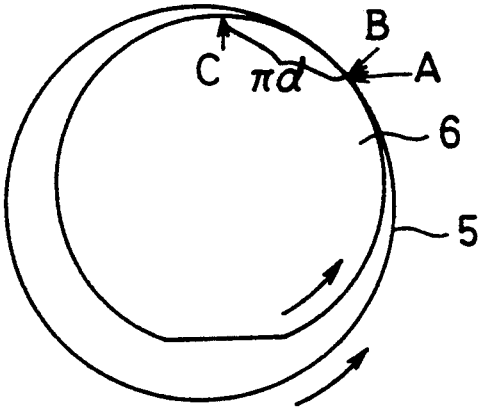

In case where the lower surface of the top ring 3 is sufficiently planarized, the semiconductor wafer 6 contacts the lower surface of the top ring 3 directly, and as shown in FIG. 5(*a*) the clearance d is formed between the inside diameter $D_1$ of the wafer retaining ring 5 and the outside diameter $D_2$ of the semiconductor wafer 6, the semiconductor wafer 6 performs a planetary motion relative to the top ring 3 in the wafer retaining ring 5, thus preventing a bull's eye on the semiconductor wafer 6 from being formed.

In this specification, the planetary motion is defined as a motion that the semiconductor wafer 6 revolves on its own axis and rotates relative to the top ring 3 about a center of the top ring 3. The semiconductor wafer 6 performs the planetary motion when the following two conditions are satisfied.

Condition 1

The frictional force between the lower surface of the top ring 3 and the semiconductor wafer 6 is smaller than the frictional force between the abrasive cloth 23 on the turntable 20 and the semiconductor wafer 6. In other words, a force applied to the semiconductor wafer 6 from the top ring 3 is counterbalanced by a force applied to the semiconductor wafer 6 from the turntable 20 in an axial direction of the top ring drive shaft 1, and therefore the above condition means that the coefficient of friction between the lower surface of the top ring 3 and the semiconductor wafer 6 is smaller than the coefficient of friction between the abrasive cloth 23 and the semiconductor wafer 6. In order to make the coefficient of friction between the lower surface of the top ring 3 and the semiconductor wafer 6 small, the lower surface of the top ring 3 must be sufficiently planarized as mentioned above.

If the above condition is not satisfied and the frictional force between the lower surface of the top ring 3 and the semiconductor wafer 6 is larger than the frictional force between the abrasive cloth 23 and the semiconductor wafer 6, the semiconductor wafer 6 moves together with the top ring 3, and thus planetary motion can not be obtained.

Condition 2

The clearance d is formed between the inside diameter $D_1$ of the wafer retaining ring 5 provided on the top ring 3 and the outside diameter $D_2$ of the semiconductor wafer 6. In case where the condition 1 is satisfied, the rotation of the turntable 20 imparts a pressing force in a direction parallel to the upper surface of the turntable 20 to the semiconductor wafer 6 so that the outer periphery of the semiconductor wafer 6 contacts the inner periphery of the wafer retaining ring 5 at a certain point (a contact point A in FIG. 4).

In case where the condition 2 is satisfied, rotation of the retaining ring 5 imparts rotational force to the semiconductor wafer 6 to thus rotate the semiconductor wafer 6. Since the inside diameter of the wafer retaining ring 5 is larger than the outside diameter of the semiconductor wafer 6, the length of the inner periphery of the wafer retaining ring 5 is longer than the length of the outer periphery of the semiconductor wafer 6. Therefore, while the top ring 3 and the wafer retaining ring 5 make one rotation, the outer periphery of the semiconductor wafer 6 passes by the contact point A in FIG. 4 and the semiconductor wafer 6 makes more than one rotation. That is, the semiconductor wafer 6 makes more than one rotation during one rotation of the top ring 3, whereby the semiconductor wafer 6 rotates about the center of the top ring 3. The semiconductor wafer 6 is rotated by the rotational force F which is given at the contact point A by rotation of the wafer retaining ring 5.

In case where the clearance d is 0.5–3 mm, and the cumulative difference between the total rotated angle of the top ring 3 and the total rotated angle of the semiconductor wafer 6 from start to finish of polishing (hereinafter referred to as the cumulative difference of the total rotational angle) is 360° or more, the semiconductor wafer 6 can be polished to a flat mirror finish having no bull's-eye.

This is because the planetary motion of the semiconductor wafer 6 can be obtained by the clearance 0.5 mm or more, and in case of the clearance of more than 3.0 mm, the semiconductor wafer 6 is liable to be damaged due to impact force when the semiconductor wafer 6 contacts the wafer retaining ring 5. Further, in case where the cumulative difference of the total rotational angle is 360° or more, the influence which dust particles exercise on the semiconductor wafer 6 is distributed over the entire surface of the semiconductor wafer 6.

According to planetary motion of the present invention, even if dust particles are interposed between the semiconductor wafer 6 and the lower surface of the top ring 3, convex surfaces formed on the semiconductor wafer 6 by dust particles are constantly moved on the semiconductor wafer 6 without remaining at original points, the influence which dust particles exercise on the semiconductor wafer 6 is distributed over the entire surface of the semiconductor wafer 6, and thus the semiconductor wafer 6 can be polished highly accurately to a flat mirror finish having no bull's eye.

FIGS. 5(*a*), 5(*b*) and 5(*c*) show the manner in which the semiconductor wafer 6 rotates. While the semiconductor wafer 6 is being pressed against the contact point A of the inner periphery of the wafer retaining ring 5 by the rotation of the turntable 20, the semiconductor wafer 6 rolls on the inner periphery of the wafer retaining 5 without slipping thereon. That is, the semiconductor wafer 6 rolls on the wafer retaining ring 5 as shown in FIGS. 5(*a*), 5(*b*) and 5(*c*). In FIGS. 5(*a*), 5(*b*) and 5(*c*), a thick arrow B shows the original point on the wafer retaining ring 5 where the semiconductor wafer 6 contacts the wafer retaining ring 5, and a thin arrow C shows the original point on the semiconductor wafer 6 where the semiconductor wafer 6 contacts the wafer retaining ring 5.

Provided that the clearance between the semiconductor wafer 6 and the wafer retaining ring 5 is d(mm) and the semiconductor wafer 6 is D(mm) in diameter, the linear length of the outer circumference of the semiconductor wafer 6 is $\pi$D(mm) and the linear length of the inner circumference of the wafer retaining ring 5 is $(D+d)\pi$(mm). The semiconductor wafer 6 goes ahead of the wafer retaining ring 5 by $\pi$d(mm) (i.e. $(D+d)\pi-\pi D$) per one revolution of the wafer retaining ring 5 as shown in FIG. 5(*c*). By converting $\pi$d(mm) into the angle of rotation, $(\pi d/\pi D)\times 360°=(d/D)\times 360°$ is obtained. When the wafer retaining ring 5 rotates at r rev/min for t(sec), the difference between the total rotational angle of the top ring 3 and the total rotational angle of the semiconductor wafer 6 (the cumulative difference of the total rotational angle) is expressed by the following formula.

$$(d/D)\times 360°\times(r/60)\times t=6(d/D)\cdot r\cdot t° \quad (1)$$

Therefore, the condition in which the cumulative difference of the total rotational angle is 360° or more is expressed as follows:

$$6(d/D)\cdot r\cdot t° \geqq 360°$$

$$\text{That is, } (d/D)\cdot r\cdot t° \geqq 60° \quad (2)$$

By selecting rotational speed r(rev/min) and polishing time t(sec) so as to satisfy the equation (2), the semiconductor wafer 6 can be polished highly accurately to a flat mirror finish having no bull's eye.

For example, in case of D=150 mm, d=2 mm, r=100(r.p.m.), t≧45(sec) is obtained from the equation (2). When polishing time is 45 seconds or more, the cumulative difference of the total rotational angle of 360° or more is obtained, and Good polishing result is obtained.

In case of D=200 mm, d=2 mm, r=100(r.p.m.), t≧60(sec) is obtained from the equation (2). When polishing time is 60 seconds or more, the cumulative difference of the total rotational angle of 360° or more is obtained, and good polishing result is obtained.

Figure 9:
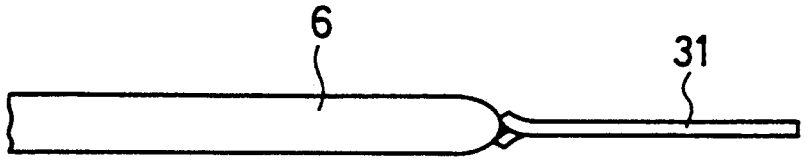
FIG. 9(*a*), FIG. 9(*b*) and FIG. 9(*c*) are views showing the test process to confirm planetary motion of the semiconductor wafer.
Figure 9:
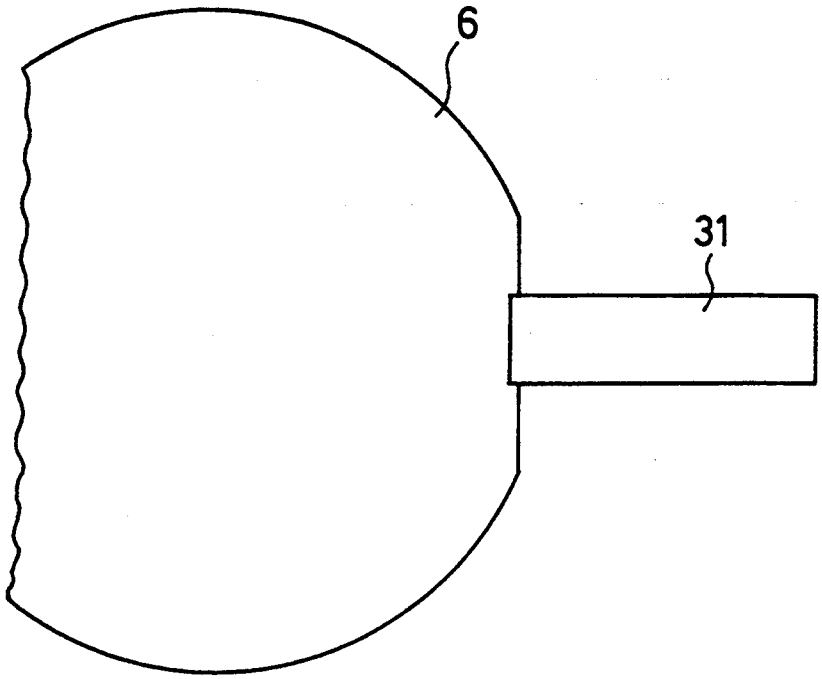
Figure 9:
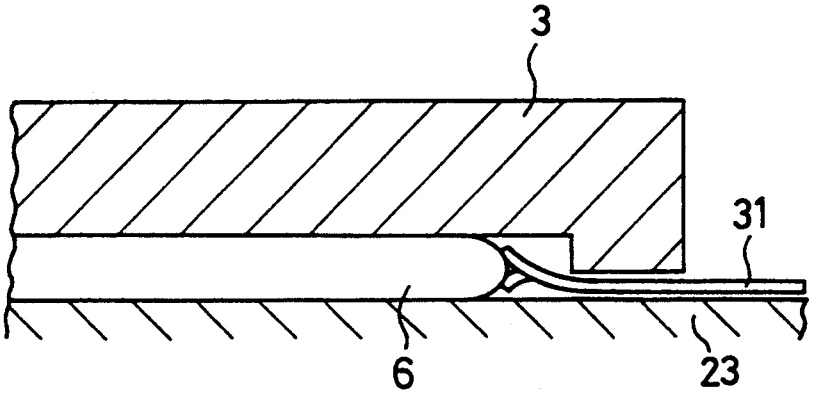

Next, in order to confirm the planetary motion of the semiconductor wafer in the wafer retaining ring 5, the following test was carried out. As shown in FIGS. 9(*a*) and 9(*b*), a semiconductor wafer which has dielectric comprising silicon dioxide deposited over a silicon substrate was used as the semiconductor wafer 6, and a metal leaf 31 (0.01 mm in thickness) was attached to the outer periphery of the semiconductor wafer 6. As shown in FIG. 9(*c*), the semiconductor wafer 6 having the metal leaf 31 was interposed between the top ring 3 and the abrasive cloth 23 in such a manner that the metal leaf 31 protrudes from the top ring 3. Thereafter, the turntable 20 and the top ring 3 was rotated, the metal leaf 31 was observed to find out the cumulative difference of the total rotational angle. TABLE 1 shows the test result.

TABLE 1

| Smaple No. | Type of the top ring | Attraction under a vacuum | Clearance d (mm) | Rotational speed of the top ring (rpm) | Rotational speed of the turntable (rpm) | Cumulative difference of the total rotational angle by acutual measuring (deg) | Theoretical cumulative difference of the total rotational angle (deg) | The number of the bull's-eye |
|---|---|---|---|---|---|---|---|---|
| 1 | A | NO | 0.5 | 100 | 100 | 90° | 90° | 0 |
| 2 | A | NO | 2 | 100 | 100 | 340° | 360° | 0 |
| 3 | A | NO | 3 | 100 | 100 | 540° | 540° | 0 |
| 4 | A | NO | 3 | 100 | 150 | 540° | 540° | 0 |
| 5 | A | NO | 3 | 150 | 100 | 750° | 810° | 0 |
| 6 | B | NO | 2 | 100 | 100 | 330° | 360° | 0 |
| 7 | B | NO | 2 | 100 | 120 | 275° | 360° | 0 |
| 8 | B | NO | 2 | 100 | 100 | 50° | 360° | 1 |
| 9 | C | NO | 0.5 | 100 | 100 | 0° | 90° | 2 |
| 10 | C | NO | 2 | 100 | 100 | 30° | 360° | 2 |
| 11 | C | NO | 3 | 100 | 100 | 70° | 540° | 0 |
| 12 | A | YES | 2 | 100 | 100 | 0° | 0° | 2 |
| 13 | B | YES | 2 | 100 | 100 | 0° | 0° | 1 |
| 14 | C | YES | 2 | 100 | 100 | 0° | 0° | 3 |

In TABLE 1, the cumulative difference of the total rotational angle by actual measurement was judged by measuring the total number of rotation of the metal leaf 31 and the top ring 3, the theoretical cumulative difference of the total rotational angle was calculated by the equation (1). As the abrasive cloth 23, a polyurethane pad manufactured by Rodel, Inc., known by the name "SUBA 800", was employed. As abrasive slurry, solution containing 1% $CeO_2$ by weight was employed. The polishing operation performed at a pressure of 300 g/cm$^2$ for 45 seconds.

Figure 10:
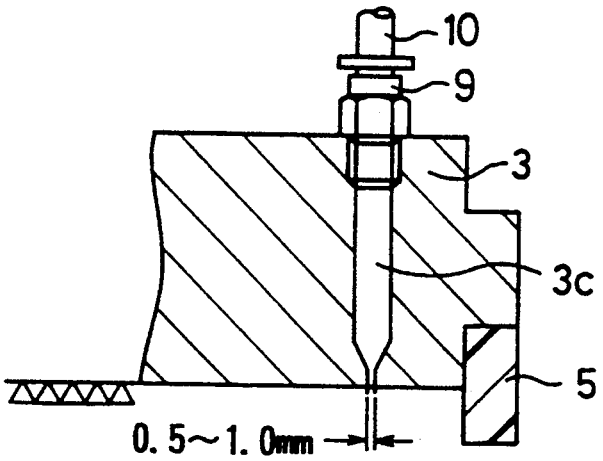
FIG. 10(*a*), FIG. 10(*b*) and FIG. 10(*c*) are sectional side views showing top rings A, B and C which are employed in the test process to confirm that the semiconductor wafer performs planetary motion.
Figure 10:
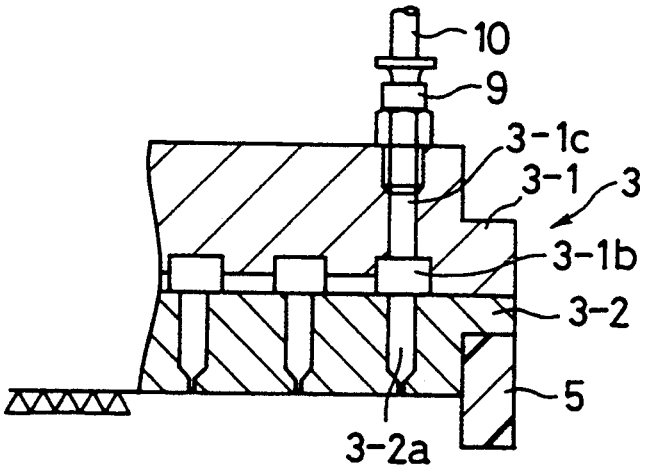
Figure 10:
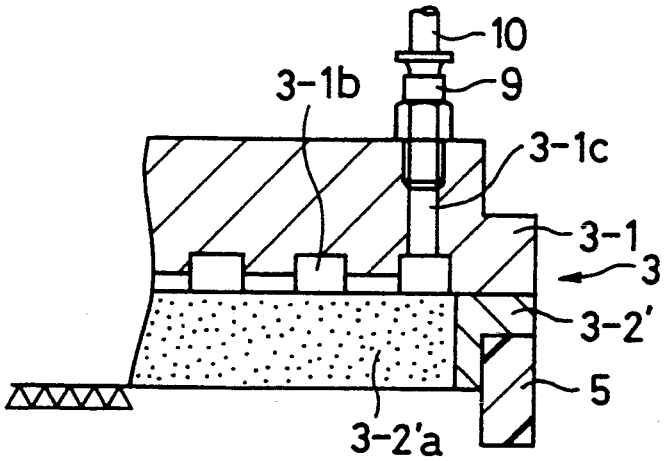

FIGS. 10(*a*), 10(*b*) and 10(*c*) show the respective structures of the top rings employed in the above mentioned test. FIG. 10(*a*) shows a top ring A, FIG. 10(*b*) shows a top ring B and FIG. 10(*c*) shows a top ring C. The top ring A comprises the top ring 3 made of ceramics containing alumina, and the wafer retaining ring 5 made of polyvinyl chloride resin. The top ring 3 has 53 vacuum holes 3*c* and the lower surface of top ring 3 is lapped to a planar mirror finish. The top ring B comprises the lower top ring member 3-2 made of ceramics containing alumina, and the wafer retaining ring 5 made of vinyl chloride resin. The top ring 3 has 233 vacuum holes 3-2*a* and the lower surface of the top ring 3 is lapped to a planar mirror finish.

Further, the top ring C comprises the lower top ring member 3-2' made of porous ceramics containing alumina. The average pore diameter of the porous ceramics is 85 μm.

As shown in TABLE 1, in the top ring A, a desired planetary motion of the semiconductor wafer was obtained. However, in the top rings B and C, a desired planetary motion was not obtained, because the top rings B and C have a number of vacuum holes 3-2*a* and a porous lower surface, respectively, resulting in failing to form a sufficient planer lower surface.

Further, the wafer retaining ring 5 which was employed in the test was made of polyvinyl chloride resin having a large coefficient of friction relative to the semiconductor wafer, however, the wafer retaining ring 5 may be made of a resin material having a hardness similar to polyvinyl chloride resin (Rockwell hardness HRB 50-150), such as ABS resin (acrylonitrile-butadiene-styrene resin), PE resin (polyethylene resin) or PC resin (polycarbonate resin).

The good polishing result was obtained, when the clearance between the inside diameter of the wafer retaining ring 5 and the outside diameter of the semiconductor wafer was 0.5 to 3.0 mm. Further, the wafer retaining ring may comprises a reinforcing member made of metal and a resin material reinforced by the reinforcing member. In this case, the reinforcing member contributes to increase rigidity of the wafer retaining ring, and resin material contributes to increase the coefficient of friction relative to the semiconductor wafer.

As shown in TABLE 1, in case where the semiconductor wafer 6 was not attached to the lower surface of the top ring under a vacuum, it was confirmed that the semiconductor wafer 6 performed planetary motion relative to the top ring 3 in the wafer retaining ring 5. In case where the semiconductor wafer 6 performed planetary motion in the wafer retaining ring 5 and the cumulative difference of the total rotational angle was 360° or more, there was no bull's-eye on the polishing surface of the semiconductor wafer 6.

Next, mechanism for forming non-bull's-eye on the polishing surface will be described below when the semiconductor wafer 6 performs planetary motion in the wafer retaining ring 5.

Figure 6:
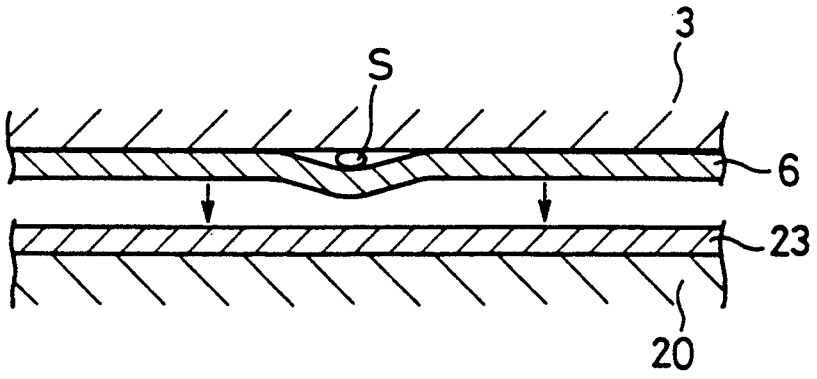
FIG. 6 is a schematic view showing the manner in which a bull's eye is formed on the semiconductor wafer.

As shown in FIG. 6, when a dust particle S is interposed between the semiconductor wafer 6 and the lower surface of the top ring 3, a concave surface is formed on the lower surface of the semiconductor wafer 6 due to the dust particle S. Therefore, the concave surface tends to be overpolished due to local contact with the abrasive cloth 23 on the turntable 20.

Figure 7:
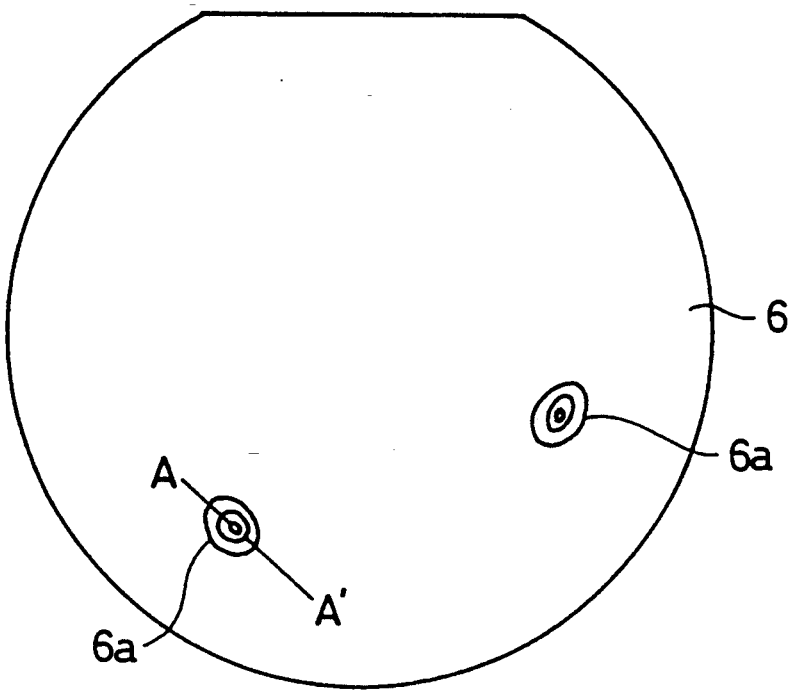
FIG. 7 is a schematic view showing the presence of bull's eyes on the semiconductor wafer.
Figure 8:
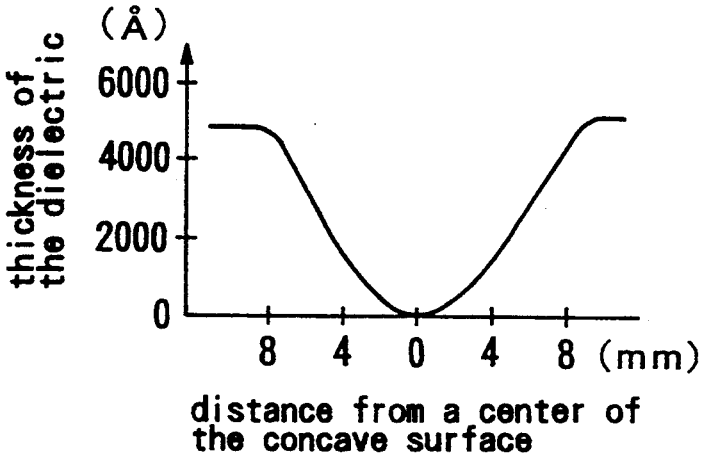
FIG. 8 is a cross-sectional view taken along line A—A' of FIG. 7.

To be more specific, the closer the surface approaches to the central portion of the concave surface, the more the surface is polished. As shown in FIG. 8, the thickness of the dielectric comprising silicon dioxide is almost zero at a center of the concave surface and becomes thicker with distance from the center of the concave surface. As a result, bull's eyes 6*a*, 6*a* having a certain pattern similar to contour lines are formed on the semiconductor wafer as shown in FIG. 7. This is because the semiconductor wafer 6 is fixed to the top ring 3, stress is concentrated on the concave surface where the dust particle S is positioned.

However, according to the present invention, since the semiconductor wafer 6 performs planetary motion relative to the top ring 3 in the wafer retaining ring 5, the concave surface which is overpolished due to the dust particle S is constantly moved on the semiconductor wafer 6 without remaining at the original point, and thus the influence which the dust particle exercises on the semiconductor wafer 6 is equalized over the entire surface of the semiconductor wafer 6 and the bull's-eye is not formed on the semiconductor wafer 6. Therefore, the semiconductor wafer 6 can be polished highly accurately to a flat mirror finish.

As another semiconductor wafer to be polished according to the present invention, a semiconductor wafer comprises a silicon substrate, a dielectric layer comprising silicon dioxide formed over the substrate and a conductive layer formed over the dielectric layer.

To be more specific, a dielectric layer is formed on a silicon substrate, and then a part of dielectric layer is etched to form grooves. Thereafter, aluminum is deposited to form a conductive layer on the grooves and the dielectric layer. Then, the conductive layer is polished by the polishing process according to the present invention.

Figure 11:
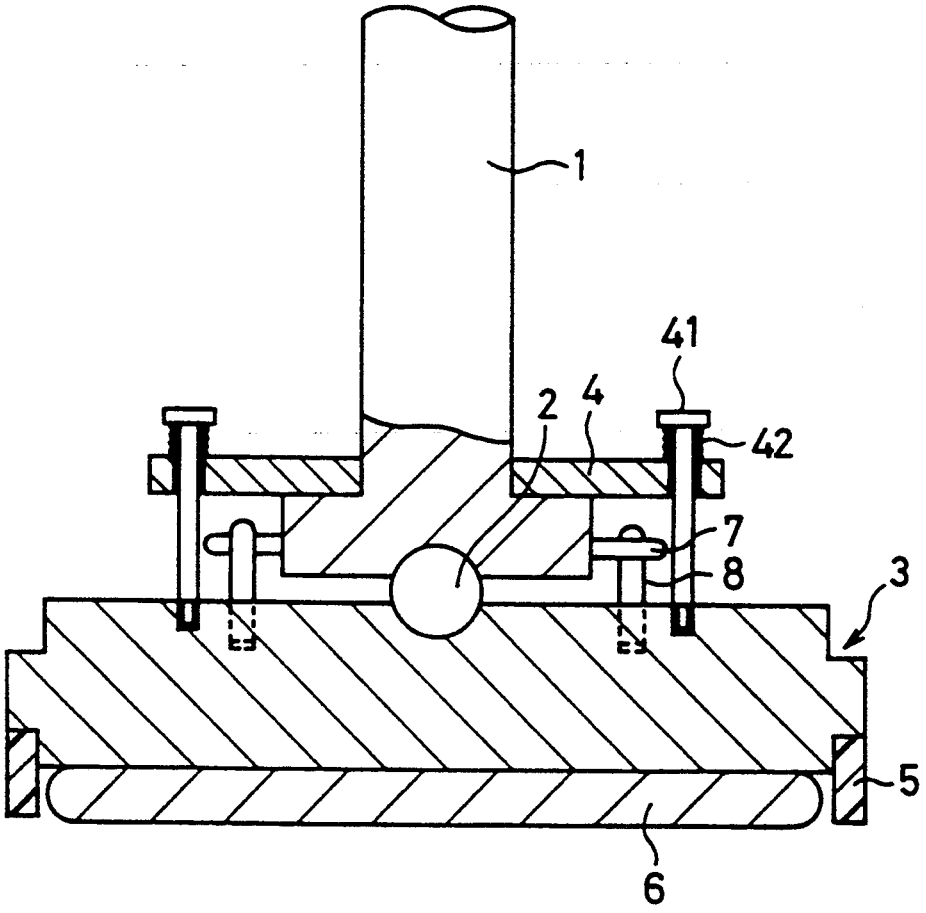
FIG. 11 is a sectional side view of a modified polishing unit of the polishing apparatus.

FIG. 11 shows a polishing unit of a polishing apparatus according to a modified embodiment of the present invention. As shown in FIG. 11, the polishing unit has a top ring 3 which is devoid of any suction holes and suction grooves, and a top ring drive shaft 1 that has no axial suction hole. Therefore, the top ring 3 shown in FIG. 11 is unable to attract a semiconductor wafer 6 to its lower surface under a vacuum. The other details of the polishing unit shown in FIG. 11 are identical to those of the polishing unit shown in FIGS. 1 and 2.

Figure 12:
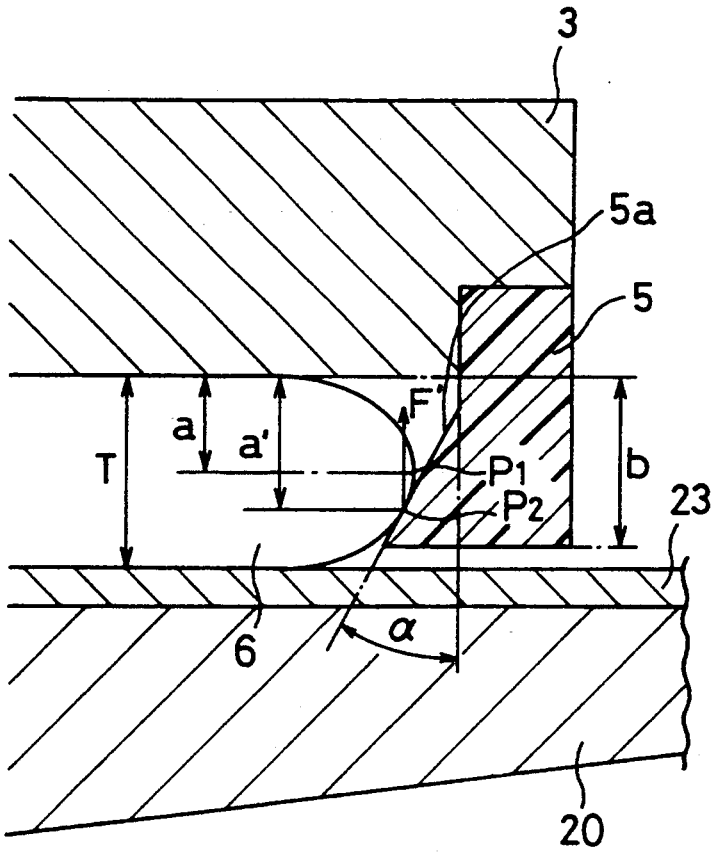
FIG. 12 is a sectional side view showing the relationship between the wafer retaining ring and the semiconductor wafer according to another embodiment of the present invention.

FIG. 12 shows a wafer retaining ring according to another embodiment of the present invention. According to the embodiment shown in FIG. 12, the wafer retaining ring 5 is provided on the lower portion of the top ring 3. The wafer retaining ring 5 has an upper thin portion, and a gradually thickening lower portion inclined radially inwardly in a downward direction, forming a tapered surface 5*a* whose angle is a with respect to a vertical plane.

As shown in FIG. 12, the semiconductor wafer 6 has an outermost circumferential edge $P_1$ and a contact point $P_2$ where the semiconductor wafer 6 contacts the tapered surface 5*a* of the wafer retaining ring 5.

The relationship between the wafer retaining ring 5 and the semiconductor wafer 6 is expressed as follows:

$$b>a',\ b<T$$

where "a" is the distance between the upper surface of the semiconductor wafer 6 and the outermost circumferential edge $P_1$ (half of thickness of the semiconductor wafer 6), "a'" is the distance between the upper surface of the semiconductor wafer 6 and the contact point $P_2$, "b" is the distance between the lower surface of the top ring 3 and the lower surface of the wafer retaining ring 5, and "T" is the thickness of the semiconductor wafer 6.

According to the embodiment shown in FIG. 12, when the semiconductor wafer 6 contacts the tapered surface 5*a* having a taper angle $\alpha$ at the contact point $P_1$, the outer edge of the semiconductor wafer 6 is lifted slightly upwardly by a force F'. As a result, the contact force between the outer edge portion of the semiconductor wafer 6 and the abrasive cloth 23 becomes weak, thus preventing the outer edge portion of the semiconductor wafer 6 from being overpolished.

In the embodiment in FIG. 12, the semiconductor wafer 6 performs the planetary motion relative to the top ring 3 in the wafer retaining ring 5, as well as in the embodiments in FIGS. 1 through 11.

Figure 13:
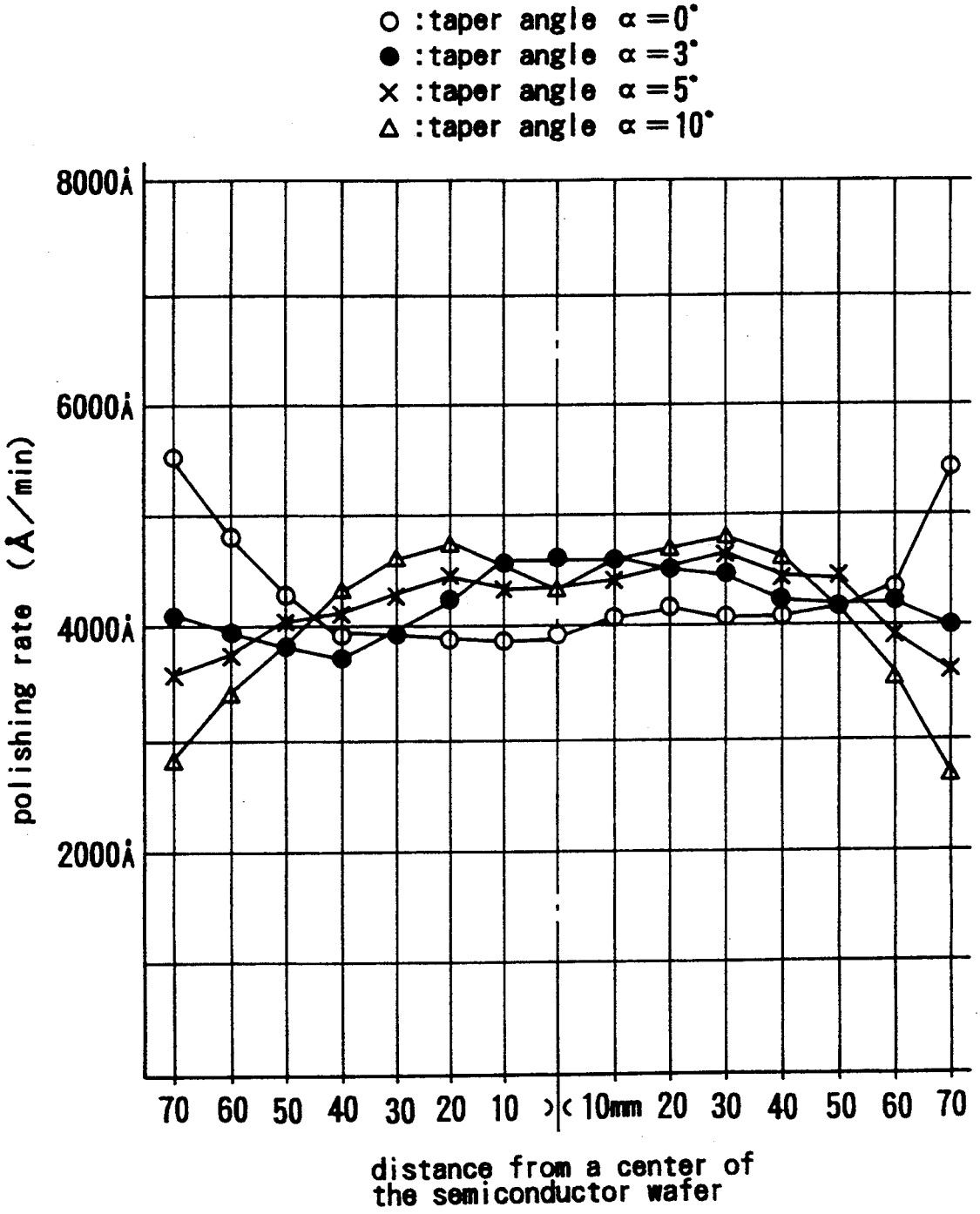
FIG. 13 is a graph showing the relationship between the polishing rate and the distance from the center of the semiconductor wafer.

FIG. 13 shows the test result showing the relationship between the polishing rate (material removal rate) (Å/min) and the distance (mm) from a center of the semiconductor wafer, using a semiconductor wafer comprising a silicon substrate and a dielectric layer comprising silicon dioxide formed over the substrate, and the dielectric layer was polished by the polishing process. In FIG. 13, open circles (○) are values when the taper angle $\alpha=0°$, closed circles (●) are values when the taper angle $\alpha=3°$, crosses(x) are values when the taper angle $\alpha=5°$ and triangles (Δ) are values when the taper angle $\alpha=10°$.

As is apparent from FIG. 13, in case of $\alpha=3°-10°$, the outer end portion of the semiconductor wafer 6 is prevented from being overpolished.

Figure 14:
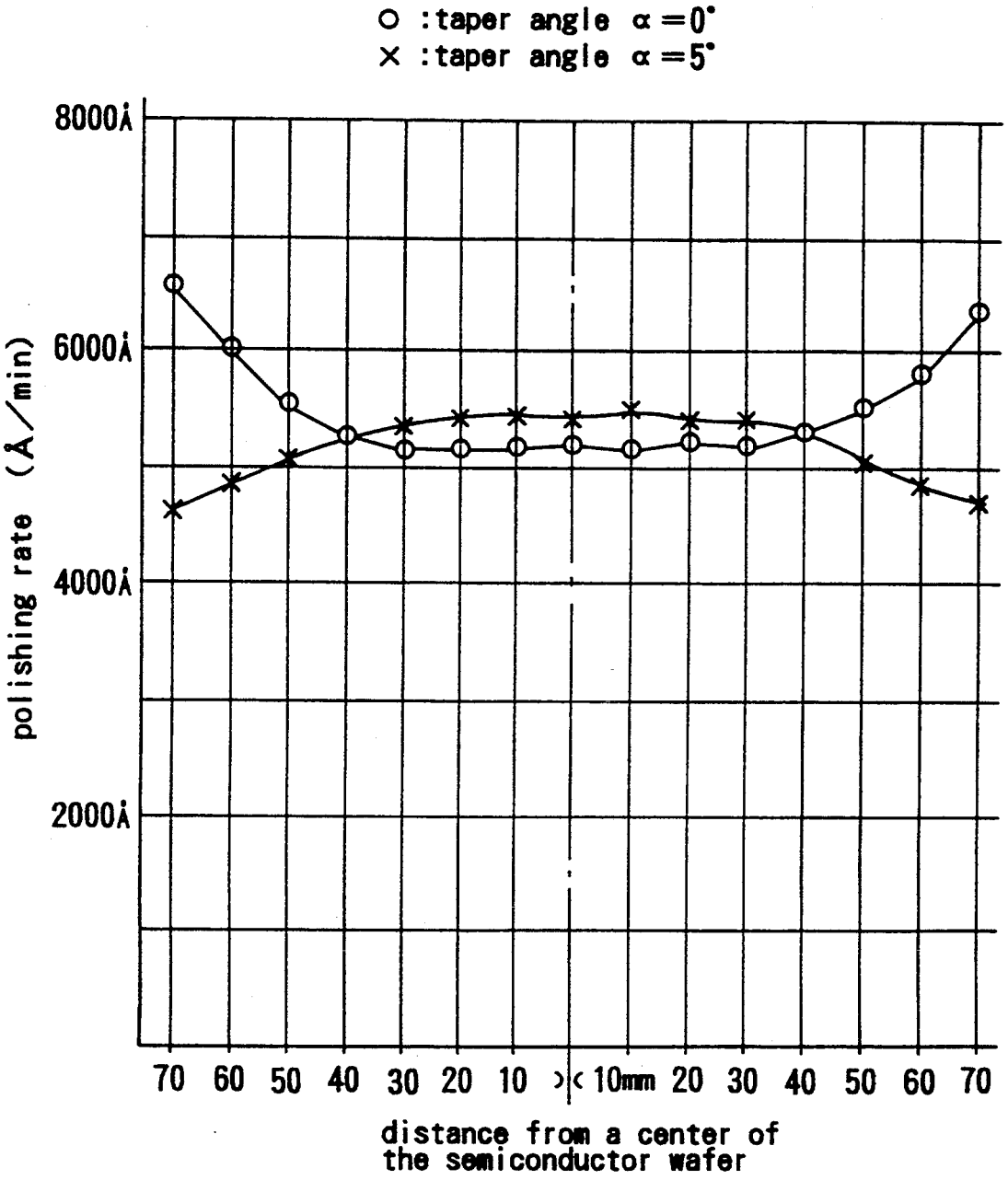
FIG. 14 is a graph showing the relationship between the polishing rate and the distance from the center of the semiconductor wafer.

FIG. 14 shows the test result showing the relationship between the polishing rate (Å/min) and the distance (mm) from the center of the semiconductor wafer, using a semiconductor wafer comprising a silicon substrate and silicon nitride layer formed over the substrate, and the silicon nitride layer was polished by the polishing process.

In FIG. 14, open circles(○) are values when the taper angle $\alpha=0°$ and crosses (x) are values when the taper angle $\alpha=5°$. As shown in FIG. 14, in case of $\alpha=5°$ the outer end portion of the semiconductor wafer 6 is prevented from being overpolished.

Figure 15:
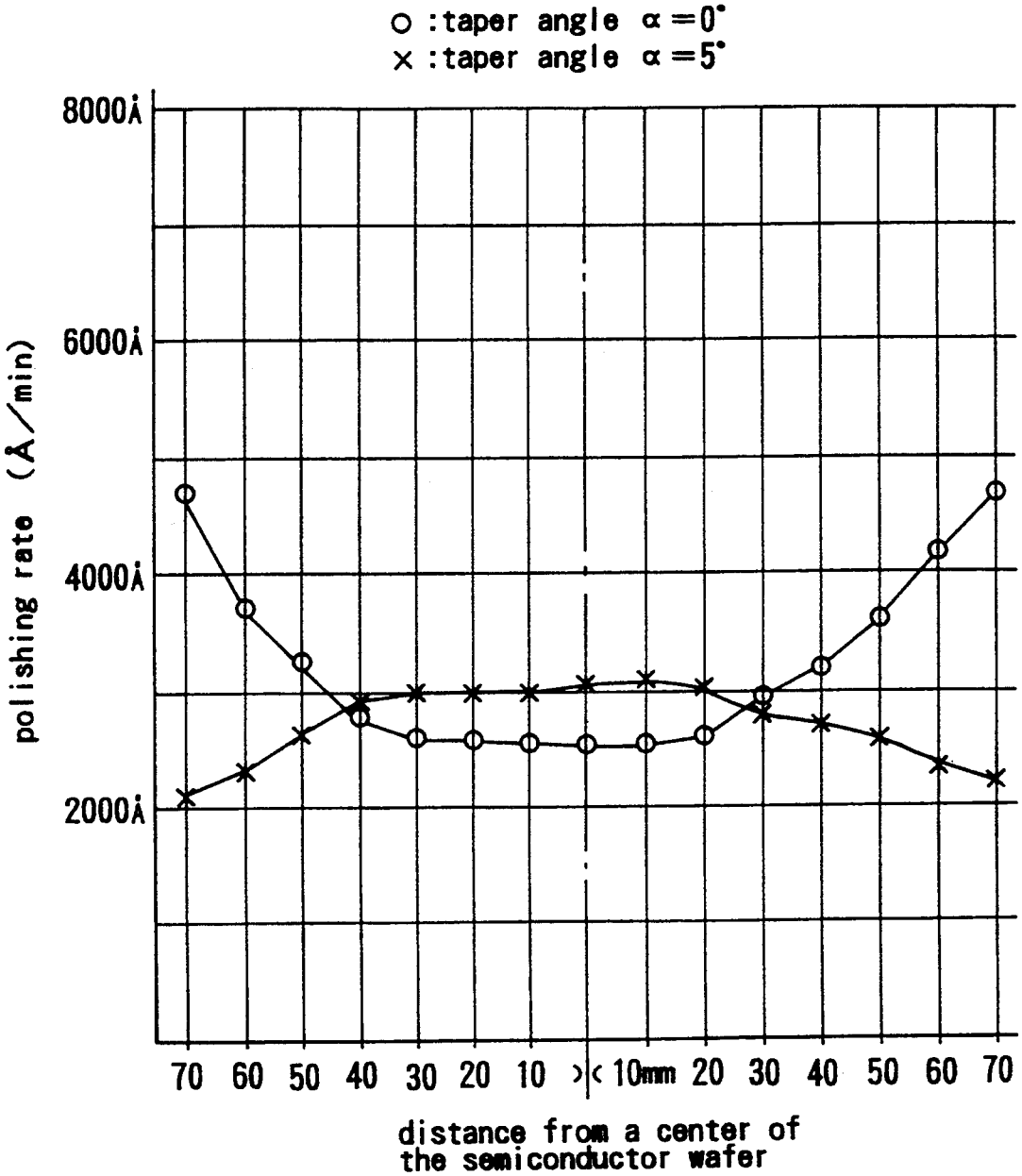
FIG. 15 is a graph showing the relationship between the polishing rate and the distance from the center of the semiconductor wafer.

FIG. 15 shows the test result showing the relationship between the polishing rate (Å/min) and the distance (mm) from a center of the semiconductor wafer, using a semiconductor wafer comprising a silicon substrate and a boron phosphorus silicate glass (BPSG) layer formed over the substrate, and the glass layer was polished by the polishing process. In FIG. 15, open circles (○) are values when the taper angle $\alpha=0°$ and crosses (x) are values when the taper angle $\alpha=5°$.

As shown in FIG. 15, in case of $\alpha=0°$, the outer end portion of the semiconductor wafer was overpolished, and in case of $\alpha=5°$, the semiconductor wafer is prevented from being overpolished.

Workpieces that can be polished by the polishing apparatus according to the present invention are not limited to semiconductor wafers, but may be various other workpieces.

In the above embodiments, though a semiconductor wafer is polished using a single top ring, a template-like top ring having a plurality of openings in which individual semiconductor wafers are polished may be used.

In the above embodiments, though the wafer retaining ring 5 comprising a separate member is fixed to the top ring 3, the wafer retaining ring may be formed integrally with the top ring.

As is apparent from the foregoing description, according to the present invention, since a workpiece such as a semiconductor wafer is not fixed to the lower surface of the top ring, the workpiece does not move together with the top ring. Since the semiconductor wafer performs planetary motion relative to the top ring 3 in the wafer retaining ring 5, the semiconductor wafer 6 is constantly moved relative to the lower surface of the top ring 3. Even if dust particles are interposed between the semiconductor wafer 6 and the lower surface of the top ring 3, the convex surfaces formed on the semiconductor wafer 6 by dust particles are constantly moved on the semiconductor wafer 6 without remaining at the original points, and hence the influence which dust particles exercise on the semiconductor wafer 6 is equalized over the entire surface of the semiconductor wafer 6, and the bull's-eye is not formed on the semiconductor wafer 6. Therefore, the semiconductor wafer 6 can be polished highly accurately to a flat mirror finish.

Although certain preferred embodiments of the present invention have been shown and described in detail, it should be understood that various changes and modifications may be made therein without departing from the scope of the appended claims.

What is claimed is:

1. A polishing apparatus for polishing a surface of a workpiece having a substantially circular shape, comprising:

a turntable with an abrasive cloth mounted on an upper surface thereof;

a top ring positioned above said turntable for supporting the workpiece to be polished and pressing the workpiece against said abrasive cloth, said top ring having a planarized lower surface which contacts an upper surface of the workpiece which is a backside of the workpiece;

first actuating means for rotating said turntable;

second actuating means for rotating said top ring; and a retaining ring provided on said lower surface of said top ring for preventing the workpiece from deviating from said lower surface of said top ring, said retaining ring having an inside diameter larger than an outside diameter of the workpiece;

wherein the rotation of said turntable imparts a pressing force in a direction parallel to said upper surface of said turntable to the workpiece so that an outer periphery of the workpiece contacts an inner periphery of said retaining ring, and the rotation of said retaining ring imparts a rotational force to the workpiece so that the workpiece performs planetary motion relative to said top ring within said retaining ring.

2. The polishing apparatus according to claim 1, wherein said retaining ring is made of a resin material.

3. The polishing apparatus according to claim 1, wherein said top ring has a plurality of suction holes connected to a vacuum source for holding the workpiece on said lower surface of said top ring under a vacuum developed by said vacuum source.

4. The polishing apparatus according to claim 1, wherein an abrasive slurry nozzle is provided to supply an abrasive slurry onto said abrasive cloth.

5. The polishing apparatus according to claim 1, wherein the clearance defined by the difference between said inside diameter of said retaining ring and said outside diameter of the workpiece is in the range of approximately 0.5 to 3 mm.

6. The polishing apparatus according to claim 1, wherein the workpiece comprises a semiconductor wafer having a substrate and a dielectric layer formed over said substrate, and a surface of the dielectric layer is planarized during polishing.

7. The polishing apparatus according to claim 1, wherein the workpiece comprises a semiconductor wafer having a substrate and a conductive layer formed over said substrate, a surface of the conductive layer is planarized during polishing.

8. The polishing apparatus according to claim 1, wherein said retaining ring has a tapered inner surface inclined radially inwardly in a downward direction thereof to lift an outer end portion of the workpiece.

9. A method of polishing a surface of a workpiece having a substantially circular shape, comprising the steps of:

positioning the workpiece between a turntable with an abrasive cloth mounted on an upper surface thereof and a top ring positioned above said turntable, said top ring having a planarized lower surface and a retaining ring provided on said lower surface, said retaining ring preventing the workpiece from deviating from said lower surface of said top ring, said retaining ring having an inside diameter larger than an outside diameter of the workpiece;

rotating said turntable and said top ring; and pressing the workpiece against said abrasive cloth by said top ring;

wherein the rotation of said turntable imparts a pressing force in a direction parallel to said upper surface of said turntable to the workpiece so that an outer periphery of the workpiece contacts an inner periphery of said retaining ring, and the rotation of said retaining ring imparts a rotational force to the workpiece so that the workpiece performs a planetary motion relative to said top ring within said retaining ring.

10. The method of polishing a surface of workpiece according to claim 9, wherein when the outside diameter of the workpiece is D(mm), the difference between the inside diameter of said retaining ring and the outside diameter of the workpiece is d(mm), the rotational speed of said top ring r(r.p.m.) and polishing time t(sec) are selected so as to satisfy $(d/D)\cdot r\cdot t \geqq 60$.

11. The method of polishing a surface of workpiece according to claim 9, further comprising the steps of:

attracting the workpiece placed at a standby section to said lower surface of said top ring under a vacuum and moving said top ring to said turntable to position the workpiece on said abrasive cloth, said standby section being located adjacent to said table; and releasing the workpiece from said top ring so that said workpiece can be freely moved in said retaining ring.

12. The method of polishing a surface of workpiece according to claim 11, further comprising the steps of:

attracting the workpiece on said abrasive cloth to said lower surface of said top ring under a vacuum after polishing; and moving said top ring to convey the workpiece to a next process.

13. The method of polishing a surface of workpiece according to claim 9, wherein the workpiece comprises a semiconductor wafer having a substrate and a dielectric layer formed over said substrate, and a surface of the dielectric layer is planarized during polishing.

14. The method of polishing a surface of workpiece according to claim 9, wherein the workpiece comprises a semiconductor wafer having a substrate and a conductive layer formed over said substrate, and a surface of the conductive layer is planarized during polishing.

15. The method of polishing a surface of workpiece according to claim 9, wherein said retaining ring has a tapered inner surface inclined radially inwardly in a downward direction thereof to lift an outer end portion of the workpiece.

* * * * *